US006467614B1

(12) United States Patent
Tallier et al.

(10) Patent No.: US 6,467,614 B1
(45) Date of Patent: Oct. 22, 2002

(54) PACKAGE PROVIDED WITH A COUPON AND METHOD FOR OBTAINING SAID PACKAGE

(75) Inventors: Bernard Tallier, Cortaillod; Jean-Pierre Fiems, Neuchâtel, both of (CH)

(73) Assignee: Philip Morris Products S.A. (CH)

( * ) Notice: Subject to any disclaimer, the term of this patent is extended or adjusted under 35 U.S.C. 154(b) by 0 days.

(21) Appl. No.: 09/701,047

(22) PCT Filed: May 26, 1999

(86) PCT No.: PCT/CH99/00228

§ 371 (c)(1),
(2), (4) Date: Nov. 22, 2000

(87) PCT Pub. No.: WO99/61348

PCT Pub. Date: Dec. 2, 1999

(30) Foreign Application Priority Data

May 26, 1998 (EP) ..... 98810491

(51) Int. Cl.[7] ..... A24F 15/00

(52) U.S. Cl. ..... 206/264; 53/412; 53/415; 40/312; 206/831; 229/87.05; 426/123

(58) Field of Search ..... 53/415, 135.2, 53/136.1, 412; 206/264, 271, 831; 40/306, 310, 312; 229/87.05; 426/123

(56) References Cited

U.S. PATENT DOCUMENTS

| | | | | |
|---|---|---|---|---|
| 3,940,496 A | * | 2/1976 | Turpin et al. | 426/123 |
| 4,077,289 A | | 3/1978 | Rudszinat | |
| 4,912,910 A | | 4/1990 | Lowe et al. | |
| 5,035,935 A | | 7/1991 | Thomas et al. | |
| 5,129,294 A | | 7/1992 | Boldrini et al. | |
| 5,137,148 A | | 8/1992 | Evers | |
| 5,160,024 A | | 11/1992 | Evers | |
| 5,178,272 A | | 1/1993 | Evers | |
| 5,203,953 A | | 4/1993 | Focke et al. | |
| 5,236,084 A | | 8/1993 | Evers | |
| 5,250,134 A | | 10/1993 | Thomas et al. | |
| 5,363,955 A | | 11/1994 | Fleenor | |
| 5,427,235 A | | 6/1995 | Powell et al. | |
| 5,657,609 A | | 8/1997 | Spada et al. | |
| 5,931,292 A | * | 8/1999 | Focke et al. | 206/264 |
| 6,036,006 A | * | 3/2000 | Focke | 206/264 |
| 6,138,823 A | | 10/2000 | Focke et al. | |
| 6,145,829 A | | 11/2000 | Furmanski et al. | |
| 6,164,444 A | | 12/2000 | Bray et al. | |
| 6,237,760 B1 | | 5/2001 | Parker et al. | |
| 6,244,017 B1 | | 6/2001 | Focke et al. | |

FOREIGN PATENT DOCUMENTS

| | | |
|---|---|---|
| EP | 0 633 201 B1 | 1/1995 |
| EP | 0 803 450 A | 10/1997 |

* cited by examiner

*Primary Examiner*—Bryon P. Gehman
(74) *Attorney, Agent, or Firm*—Burns, Doane, Swecker & Mathis, LLP

(57) ABSTRACT

A wrapping for an object includes an opening line made up of a tear tape by which the user opens the wrapping in order to gain access to its contents. A coupon bearing markings for publicity or other reasons is attached to a face of the wrapped object. The coupon also includes an opening line allowing access to information contained on inner pages of a coupon. The opening line of the wrapping and the opening line of the coupon are juxtaposed so that the user simultaneously opens the coupon and the wrapping.

25 Claims, 6 Drawing Sheets

FIG. 7A
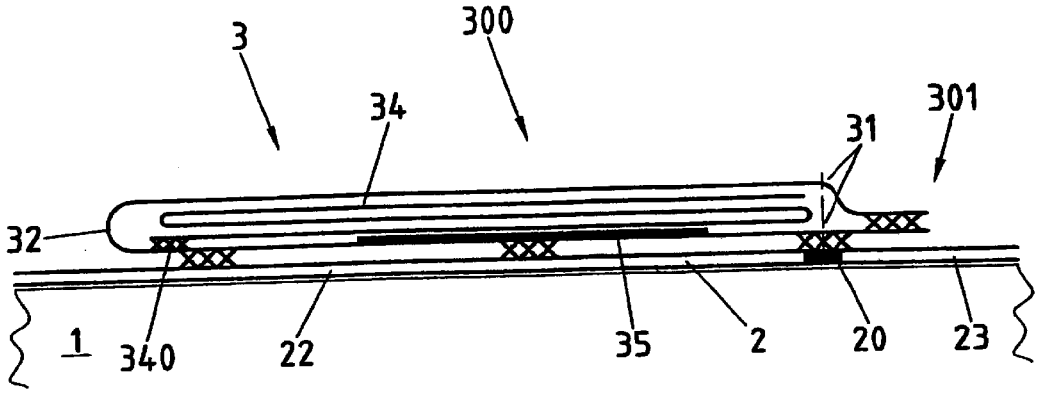
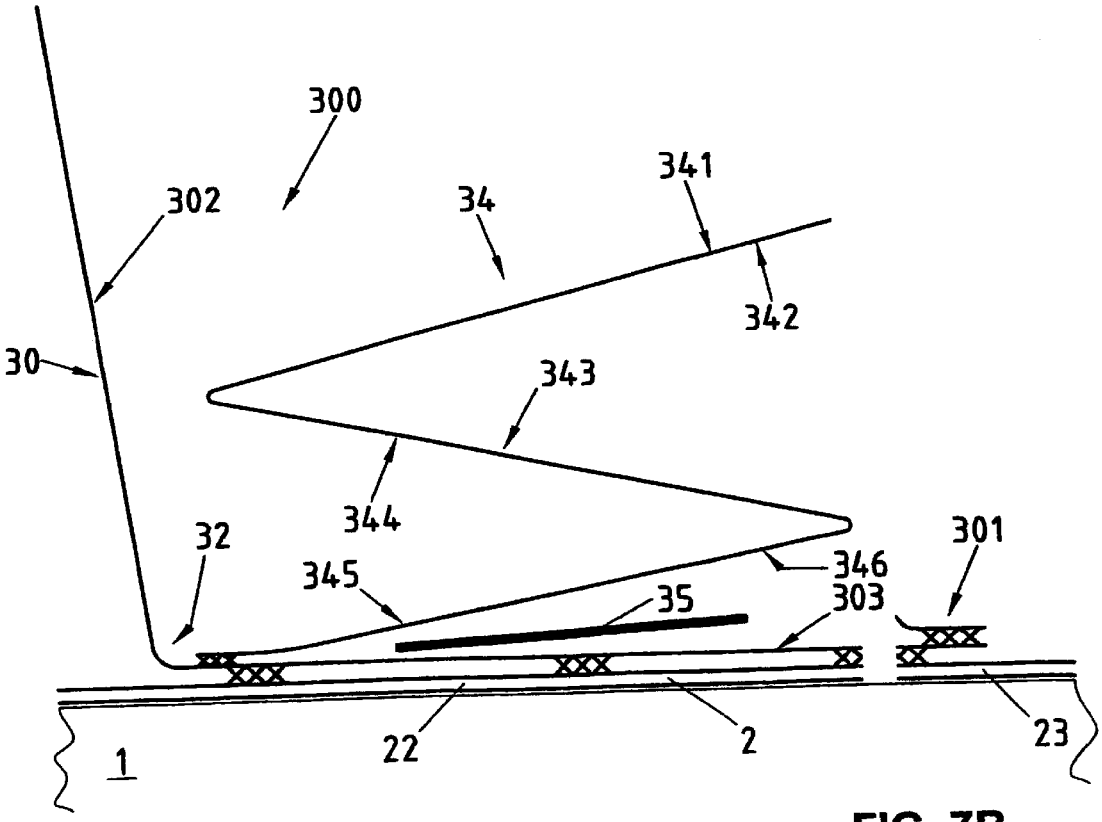
FIG. 7B

PACKAGE PROVIDED WITH A COUPON AND METHOD FOR OBTAINING SAID PACKAGE

FIELD OF THE INVENTION

The present invention relates to a wrapping provided with a publicity or other coupon on at least one of its outside faces, as well as to a process permitting such a wrapping to be made.

BACKGROUND OF THE INVENTION

Wrappings, especially but not exclusively cigarette packs, are found provided on one face with a coupon which can be opened in order to be read, said coupon bearing publicity indications, directions for use, indications for a contest, or any other appropriate indications.

U.S. Pat. No. 5,035,935 describes a pack of cigarettes provided with such a coupon disposed under the transparent film covering the pack of cigarettes. Such an arrangement necessitates removing the transparent film completely before being able to get to the coupon. On the other hand, in view of the necessity of the transparent film, this arrangement cannot be adapted to a wrapping made up of a single layer, i.e., without the outside transparent film. Another drawback of the means proposed is that it is not possible to open the pack of cigarettes and the coupon simultaneously.

EP Application No. EP-A-0 803 450 also describes a pack of cigarettes provided with a tax coupon under the outside transparent film. Seeing that the coupon is attached to the surface of the web of film which will be situated against the pack of cigarettes, it is necessary to provide for an additional step at the time of production of the film in order to dispose the tear tape simultaneously permitting opening of the transparent film and tearing of the tax coupon. Note that in this case, the tax coupon is not intended to be read after opening of the pack.

SUMMARY OF THE INVENTION

A first object of the invention is therefore to propose a wrapping of one or of a plurality of packs or of objects, provided on at least one of its outside faces with a closed coupon, the means for opening the wrapping and the coupon being coordinated in such a way that opening of the wrapping causes simultaneous opening of the coupon.

A second object of the invention is to permit such an arrangement to be adapted to all sorts of wrappings, especially but not exclusively to wrappings of packs of cigarettes, of the stiff or soft type including an outside wrapping film or of the soft type made up of a single thickness, i.e., without the outer film.

A third object of the invention is to permit such an arrangement to be adapted to all sorts of coupons, e.g., coupons partially or totally covering one or two faces of the wrapping, coupons of various shapes and sizes, coupons which can contain an inner insert unfoldable in any way, coupons which can contain a detachable insert, etc.

Another object of the invention is to propose at least one process for producing such a wrapping.

BRIEF DESCRIPTION OF THE DRAWINGS

Several particular embodiments of a wrapping according to the invention or of a manufacturing process are described below, the description to be considered with reference to the accompanying drawing comprising figures in which:

FIGS. 7A and 7B are cross-sections of another embodiment of a coupon, in closed state and in open state, respectively, FIG. 8 describes diagrammatically a first process permitting a wrapping provided with a coupon to be obtained, and FIG. 9 describes diagrammatically another process permitting a wrapping provided with a coupon to be obtained.

DETAILED DESCRIPTION OF THE INVENTION

Although the figures and the following description relate to a pack of cigarettes, the concepts of pack and of wrapping must be extended to any type of wrapping of any product on which a coupon can be disposed according to one or the other of the ways described. The shape of the wrapping need also not be that of a parallelepiped as shown, but may be of a different shape, e.g., circular cylindrical.

Figure 1:
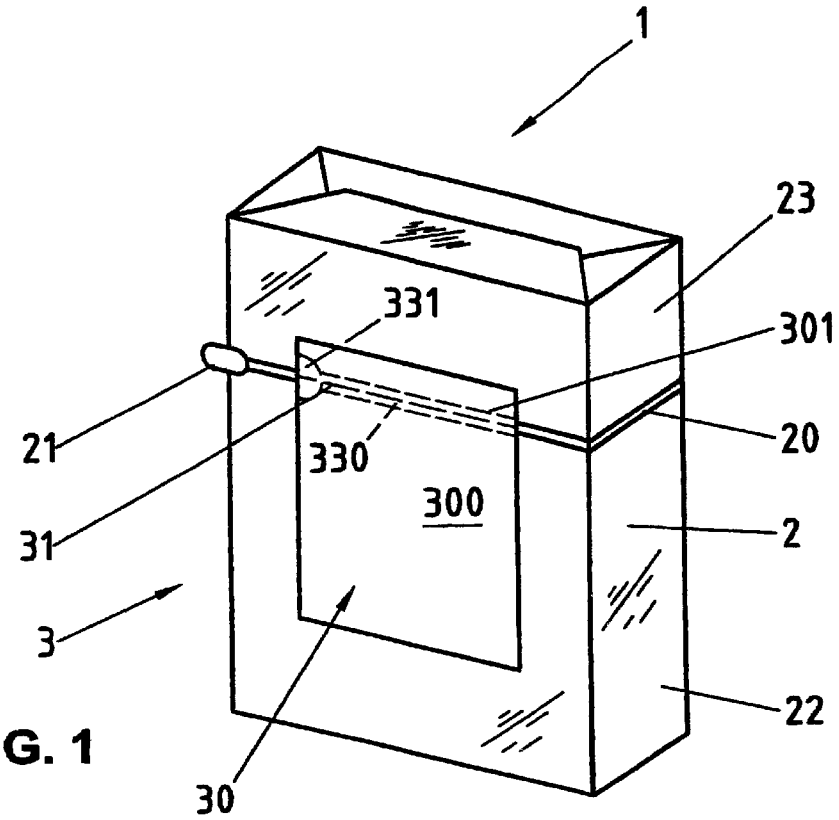
FIG. 1 represents a first embodiment of a wrapping provided with a coupon according to the invention, in a closed state.

In FIG. 1 there is a pack of cigarettes 1, e.g., of the stiff type, covered with a film 2 of a preferably transparent material such as cellophane, polypropylene, or any other material customarily used for this purpose. Here the pack 1 is provided with a coupon 3 disposed on one of its faces, outside the film 2. The outside face 30 of the coupon 3 is visible and may bear a logo, a publicity indication, or any other indication. At the time of the sale of the pack 1, the coupon 3 must be closed; it must be possible to open it to read the information it contains or to get to its contents only at the time of or after opening of the pack 1. The way in which the coupon 3 is closed is described in detail below with reference to the explanations concerning FIG. 6A.

For opening the pack 1, the film 2 is conventionally provided here with a tear tape 20, integrated in the film 2 and going around the side faces of the pack 1, one end of the tear tape 20 being provided with a tear tongue 21, shown here unfolded for being grasped. The coupon 3 is provided with a line 31, the mechanical resistance of which is weakened, e.g., by successive perforations, this line of weakened resistance 31 being disposed essentially parallel to and facing a portion of the tear tape 20. The line of weakened resistance separates the coupon 3 into two portions, a first portion 300, the larger one, which is attached to the portion 22 of the film 2 which will remain on the pack 1 after its opening, and a second portion 301 which is attached to the portion 23 of the film 2 which will be removed at the time of opening of the pack 1, then disposed of. Thus, in view of the congruence of the line 31 on the tear tape 20, at the time of opening of the pack 1 by pulling on the tear tape 20 to remove the upper portion 23 of the film 2, the coupon 3 is opened simultaneously, permitting the user to get to the information it contains.

Figure 2:
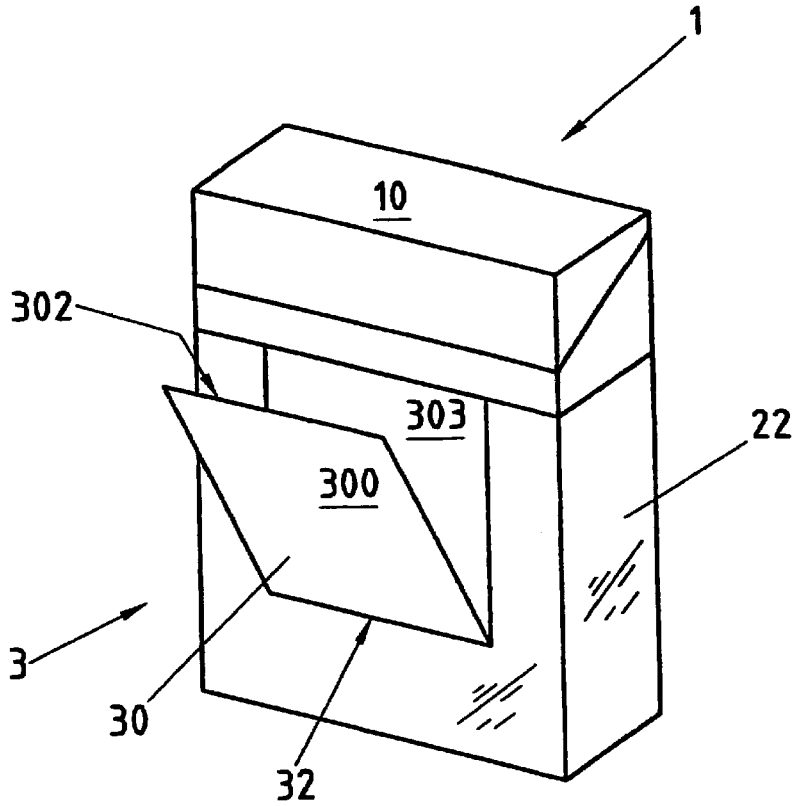
FIG. 2 represents the same wrapping as that of FIG. 1 when a portion of the transparent film has been removed and the coupon is open.

FIG. 2 shows the same pack when the tear tape 20 and the upper portion 23 of the film 2 have been removed, leaving the lower portion 22 of the film 2 on the pack 1, to which portion the coupon 3 is attached. The upper portion 10 of the pack 1 may now be opened conventionally to get to the cigarettes or other objects it contains. Simultaneously, the faces or inside pages 302 and 303 of the coupon 3 which could not be reached previously when the wrapping was closed are now accessible by unfolding the coupon 3 about a fold 32.

Figure 3:
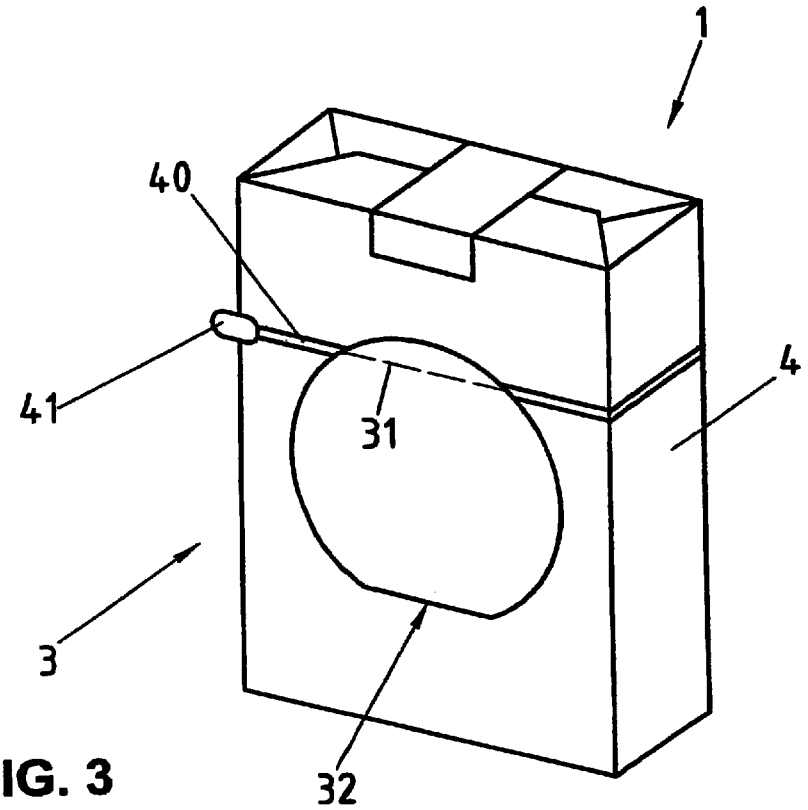
FIG. 3 represents another embodiment of a wrapping provided with a coupon.

FIG. 3 shows another embodiment of a pack of cigarettes 1, the wrapping 4 of which is obtained from a single sheet of a single layer, as described in EP Patent No. EP-B-0 633 201, for example. Such a wrapping relating to a soft-type pack of cigarettes does not include the film 2 of the previous wrapping. Such a wrapping may be provided with a tear tape 40 and with a tear tongue 41. The coupon 3 is shown here in essentially circular shape but might also be of a different shape, including a fold 32 for opening as mentioned previously, as well as a line of weakened resistance 31.

Figure 4:
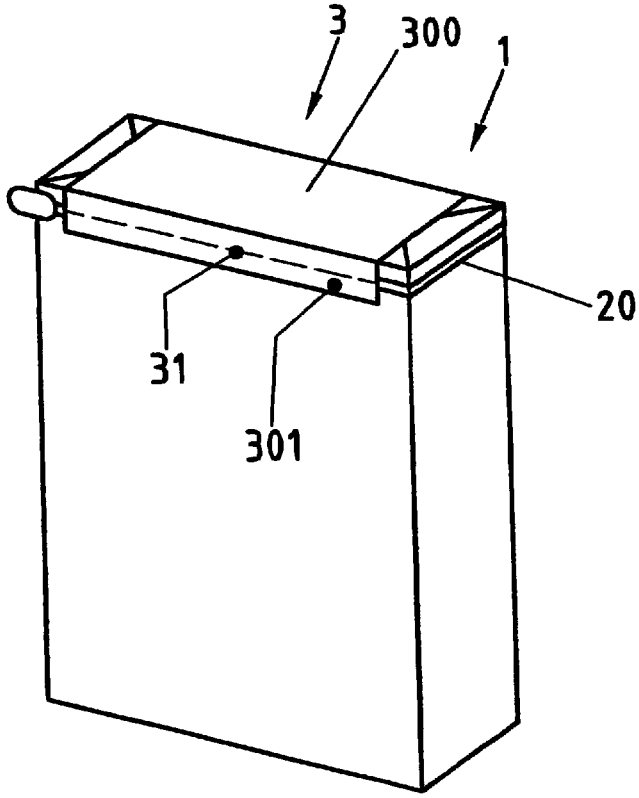
FIG. 4 represents still another embodiment of a wrapping provided with a coupon.

In the above embodiments, it is noted that the top face of the pack 1 includes the folded closures of the film 2 for the embodiment of FIG. 1, or of the wrapping blank 4 for the embodiment of FIG. 3. Such an arrangement of a face prevents disposing the tear tape there in view of the superimposition of the folded layers. Nevertheless, if it is desired to dispose a coupon 3 on a face of the pack 1 comprising folds of the film or of the wrapping sheet as, for example, the top face or the bottom face, it is possible to fit out the pack 1 as shown in FIG. 4, i.e., by providing that the tear tape 20 is disposed close to the edge of the top face and attaching the main portion 300 of the coupon 3 essentially to the top face, while the portion 301 is folded down on a side face so that the line of weakened resistance 31 is superimposed on a portion of the tear tape 20.

Figure 5:
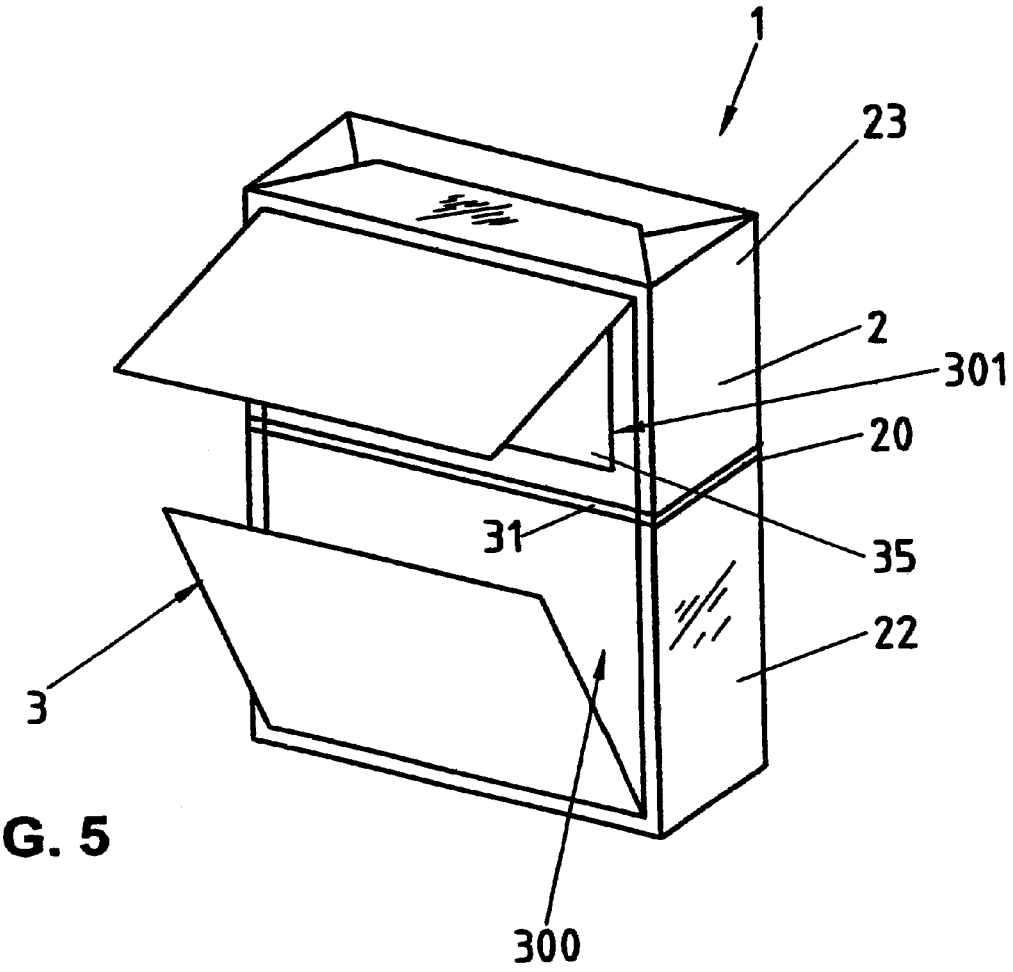
FIG. 5 represents still another embodiment of a wrapping provided with a coupon.

FIG. 5 shows still another embodiment of a coupon 3 which here opens into two sections. The coupon 3 shown here essentially covers a whole face of the pack 1. The tear tape 20 is no longer disposed close to an edge of the coupon 3 but in a more central position, so that the coupon opens into two opposing sections. In the example shown in the figure, the tear tape 20 has been removed, which has torn the line of pre-weakened resistance 31 of the coupon 3 and permitted the two sections to be opened. It is not necessary for the two portions 300 and 301 of the coupon 3 to be of equal size; one or the other of the two said portions may be larger than the other. Similarly, it is not obligatory for the coupon 3 to be disposed so that the opening line 31 is parallel to the folding line 32; by disposing these two lines at a certain angle to one another, the two sections may be given different shapes. The portion 301 attached to the portion 23 of the wrapping to be disposed of may, for example, adhere there so that it can easily be partially or totally detached therefrom, or else contain a detachable self-adhesive insert 35. According to a modification of this embodiment, the portion 300 of the coupon is disposed on a frontal or lateral face of the pack, while the portion 301 is disposed on a top face of the pack, as shown in FIG. 4. Such a modification is particularly well adapted to a soft-type, single-layer pack, as described above.

Figure 6A:
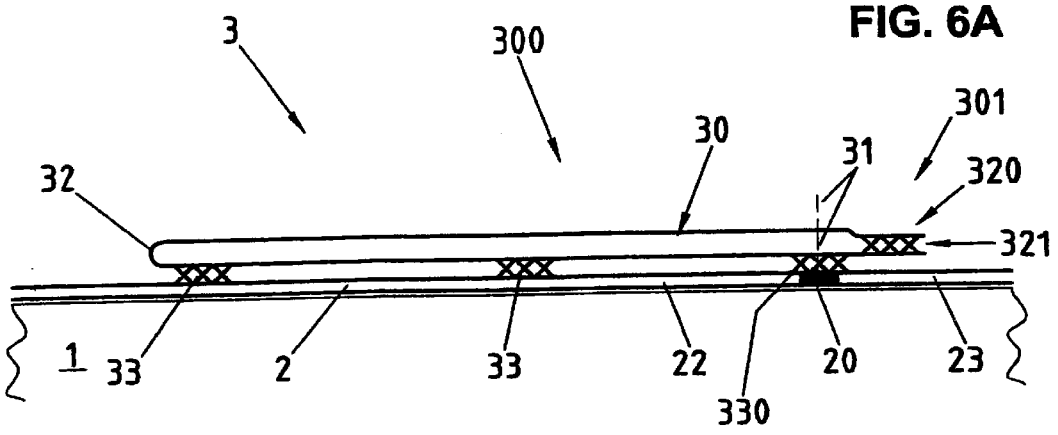
FIGS. 6A and 6B are cross-sections of a first embodiment of a coupon, in closed state and in open state, respectively.
Figure 6B:
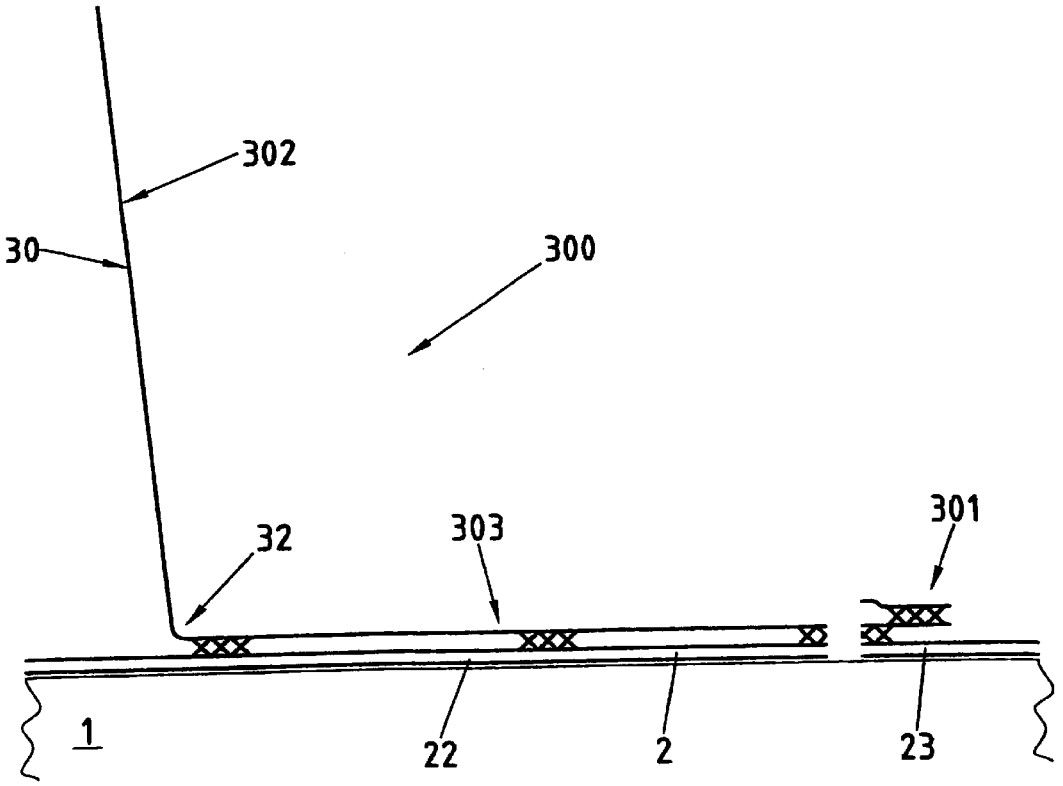

FIGS. 6A and 6B, as well as 7A and 7B, show, in section, two possible embodiments of a coupon 3.

In FIG. 6A, the coupon 3 is formed of a leaf, folded about a folding line forming a fold 32, the portion 320 of the coupon 3 opposite the fold 32 being closed, e.g., by a closure means, e.g., a spot or a line of glue 321, or by crimping, so as to keep the coupon closed before opening of the wrapping. It is also possible, instead of a folded leaf, to have two leaves assembled along the line 32, as well as on the opposite portion 320. The line 31 of pre-weakened resistance, e.g., a pre-cut line laid out on the two superimposed portions of the leaf, is here disposed close to this closure line 321, the line of weakened resistance 31 separating the coupon 3 into a main portion 300 and another portion 301. The face of this assembly, opposite the face 30 which is visible on the outside of the pack 1, is glued at least partially to a corresponding portion of the film 2, so that the line of pre-weakened resistance 31 is parallel to and approximately superimposed on a portion of the tear tape 20, the main portion 300 of the coupon 3 is superimposed on the portion 22 of the film 2 which will subsequently remain on the pack 1, and the other portion 301 of the coupon 3 bearing the closure line 321 is superimposed on the portion 23 of the film 2 which will be removed after opening of the pack 1. Preferably, the face of the coupon 3 to be glued on the film 2 is self-adhesive, but it is also possible to provide for a few gluing spots or lines 33. For good opening of the coupon 3, it is necessary that at least the portion 331 (cf. FIG. 1) of coupon 3, bearing the end of the line of pre-weakened resistance 31 at which the opening of the coupon 3 is started, be well glued by the gluing line 330 to the corresponding portion of the film 2 bearing the tear strip 20. In this way, when the user removes the tear strip 20, the corresponding portion of the coupon 3 remains attached thereto, and its opening is facilitated.

FIG. 6B shows the same coupon 3 after its opening, and the opening of the film 2, respectively. For this purpose, the user has pulled on the tear tape 20, separating the film 2 into its two portions 22 and 23. The main portion 300 of the coupon 3 remains attached to the portion 22 of the film 2 which remains on the pack 1, whereas the portion 301 of the coupon 3 is disposed of with the portion 23 of the film 2. In view of the opening of the line of pre-weakened resistance, it now becomes possible to open the coupon 3 by unfolding it about the fold 32 and to read the information contained on the inner pages 302 and 303 of the coupon 3.

As indicated above with reference to FIG. 5, it is not necessary for the line of pre-weakened resistance 31 to be disposed close to the portion 320 of the coupon, but it may be disposed at any location between this portion and the fold 32.

FIG. 7A shows a coupon 3 according to another embodiment. The coupon 3 is essentially made up and is attached exactly in the same way as that described just previously, except that a second leaf 34 folded, e.g., in accordion pleats, and attached by gluing 340 to a portion of the face 303 of the first leaf near the fold 32. The length of each folded page of the leaf 34 is such that these pages do not intercept the line of pre-weakened resistance 31 of the first leaf. As mentioned previously, after opening of the pack and of the coupon 3, it is possible to get to the pages 341 to 346 of the leaf 34 in addition to the pages 302 and 303 of the first leaf.

As a modification, it is possible to dispose a self-adhesive insert 35 on any one of the pages 341 to 346 or 302 and 303; this self-adhesive insert may represent points to be collected, a voucher for participation in a contest or a lottery, or any other object of the same kind; said insert 35 can be unstuck when the coupon 3 is open. Such an insert may obviously be provided for on a coupon according to the first embodiment described.

The embodiments described of a coupon 3 disposed on a film 2 are obviously also valid for the same coupon 3 disposed on a wrapping sheet 4 as in the embodiment of the wrapping of FIG. 3.

FIGS. 6A and 6B, as well as 7A and 7B, show two possible embodiments of a coupon 3 among numerous possibilities; in particular, the coupon 3 may be made up of more than two leaves, possibly folded or glued in a different way from what has been shown; each leaf may include a number of pages other than what has been described; the make-up of the coupon 3 may be different, e.g., in the form of a little booklet rather than of pages unfoldable in accordion pleats. The length and width dimensions of the coupon 3 are essentially determined by those of the face of the pack 1 to which the coupon 3 will be glued. It is seen in FIGS. 1 and 3 that the coupon covers a portion of a frontal face, whereas the coupon of FIG. 5 completely covers a face and that of FIG. 4 partially covers two adjacent faces. FIG. 3 shows that the coupon 3 may be of a shape other than square or rectangular. The line of weakened resistance 31 may be of any appropriate type, e.g., a tear strip, a perforated line, or a line of locally reduced thickness. Preferably, the coupon 3 closed as indicated previously and provided with its line of pre-weakened resistance 31, provided with a self-sticking adhesion layer or not, is obtained as is from the coupon manufacturer to be applied to the wrapping as described below.

As concerns the wrapping, it has been stated that it may be a hard-type or soft-type wrapping, covered with a outside protective film or not, not exclusively intended to wrap cigarettes or other products of the tobacco industry. In fact, from the foregoing description, it is understood that a coupon 3, according to any one of the described or possible embodiments, may be disposed on the outermost layer of any type of wrapping comprising an opening means similar to a tear tape. It may, as described, have to do with the wrapping of some sort of products of the tobacco industry, of the food industry, or another industry; the wrapping concerned here may be an outside wrapping which wraps a plurality of packs or objects of any shape, such as a wrapping of a carton of cigarettes, for example. The possible opening means or mechanism of the wrapping capable of functioning as described may be slightly different from what has been described, e.g., the tear tape 20 or 40 may be replaced by a tear thread disposed inside the wrapping and following the same path as described for the tear strip. It may also be a line of pre-weakened resistance, obtained for instance by successive perforations or, more generally, by a reduction of the mechanical resistance to traction along a given line of the wrapping, e.g., a local reduction of thickness of the wrapping sheet obtained by any known means.

Several processes can be envisaged permitting such a wrapping provided with a coupon 3 to be obtained.

Figure 8:
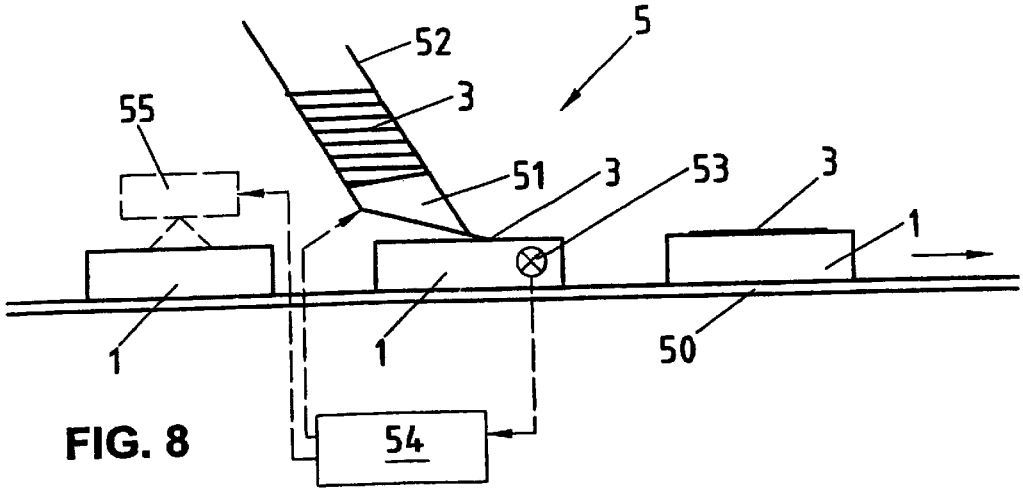

FIG. 8 shows very diagrammatically a first example of a process for obtaining a wrapping provided with a coupon according any of the embodiments or modifications described. This process is based on the fact that the coupon 3 is to be placed on the outside of the wrapping and that it may therefore be placed on the pack 1 of which the wrapping is finished.

On a machine portion 5 on which the packs 1 circulate or are carried, e.g., on an endless belt 50, in the direction indicated by the arrow, there is a distributor 51, known per se, equipped with a reservoir filled with coupons 3. A sensor 53, e.g., a photoelectric cell, permits detection of the presence and position of a pack 1 within the radius of action of the distributor 51 and, via the control unit 54, controls the actuating of the distributor 51 in order for it to place a coupon 3 on the pack 1 detected, according to a position calculated so as to cause the line of pre-weakened resistance of the coupon 3 to correspond to that of the wrapping of the pack 1. If the back of the coupon 3 is self-adhesive, it adheres directly to the wrapping. If not, a supplementary device 55 for applying spots of glue, lines of glue, or a glued surface is also controlled by the control unit 54 in order to prepare the gluing on a pack 1 before application of the coupon 3.

The advantage of this process is that the equipment necessary is of a very simple design, not cumbersome, and may be installed on any portion of a machine 5 where the packs I circulate as described. It may even be installed on a simple installation for the transfer of packs 1.

Figure 9:
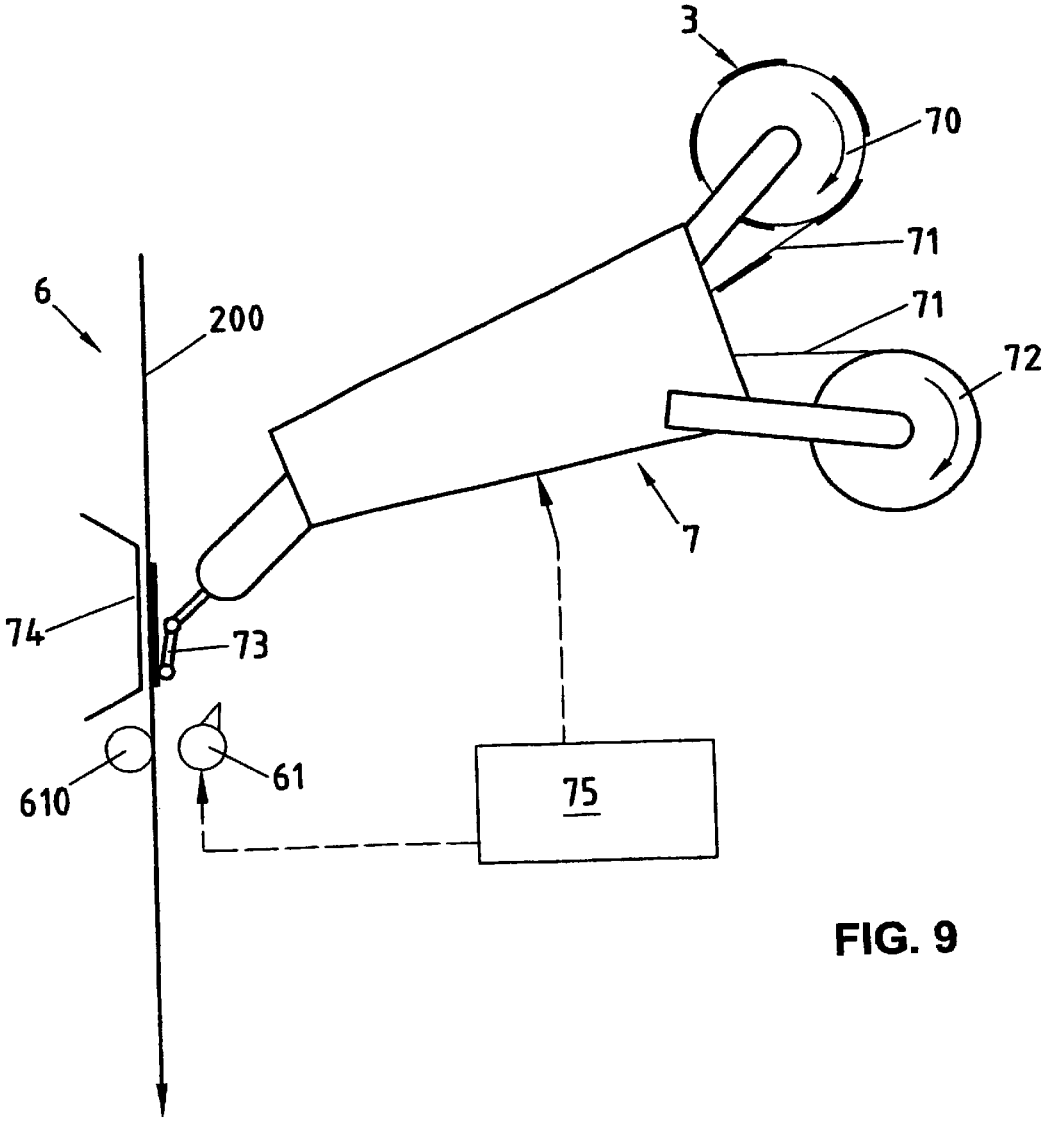

FIG. 9 also shows very diagrammatically another example of a process for obtaining a wrapping provided with a coupon according to any of the embodiments or modifications described. In this case, the coupon 3 is disposed on the wrapping portion before it is applied to the object or pack to be wrapped.

The machine portion 6 shown here is, for example, the portion of a machine for preparation of a wrapping starting from a web 200 of the material intended to form the wrapping, said web being unrolled from a reel not shown in the figure. Drive means, also not shown, drive the web 200 in the direction indicated by the arrow. A cutting means, diagrammed as the rotary cutter 61 and the counter-roller 610, sequentially cuts the web 200 in order to form the blanks intended to become the wrappings 2. Actuating of the rotary cutter 61 is controlled by the control unit 75. After cutting of the web 200, the blanks are treated in a manner known per se so that each constitutes a wrapping 2. The first line of pre-weakened resistance 20 has generally already been made longitudinally on the web 200.

The device described above is supplemented here by a placing arm 7 known per se, used here for placing coupons 3. The placing arm 7 includes means for supporting a first reel 70 of a tape 71 to which the coupons 3 adhere temporarily, being disposed one after the other on the tape 71, slightly spaced from one another. The placing arm 7 also includes means for supporting a second reel 72 responsible for winding up the tape 71 after the coupons 3 have been detached from it in a manner known per se within the placing arm 7. Each coupon 3 detached is then brought, by pneumatic or other means, onto a placing finger 73 placed in immediate proximity to the portion of the web 200 in movement immediately preceding the rotary cutter 61, the placing finger 73 applying the coupon 3 to said portion, in such a way that the line of pre-weakened resistance 31 of the coupon is placed facing the first line of pre-weakened resistance existing on the web 200 by a correct lateral keying of the placing finger 73 relative to the width of the web 200. A plane support surface 74 may be provided on the other side of said portion in order to offer a stable support at the time of this operation. As mentioned previously, the coupon 3 may be self-adhesive, or else glue-placing means similar to those described above may be provided for causing the coupon 3 to adhere to the web 200. The control unit 75 ensures the synchronization of the action of the placing finger 73 with the rotary cutter 61 so that each coupon 3 is placed correctly, i.e., that its placement position along the web 200 corresponds to the location corresponding to the face of the finished wrapping on which it is to be placed.

This example of a process for placing the coupon 3 is solely illustrative of a way of applying the coupon 3 to a web 200 of the product intended to constitute the wrapping. Other devices for treatment of a web 200 are known, all generally being able to be equipped with a placement arm 7, synchronized with some means of the machine so as to align the two lines of pre-weakened resistance and to position the coupon on the web.

It is obviously also possible to equip an installation for transferring wrapped packs, as shown in FIG. 8, with a placing arm 7 as shown in FIG. 9, just as it is also possible to equip the installation for preparing a wrapping from a web, shown in FIG. 9, with a distributor 51 as shown in FIG. 8.

Tests have shown that for good simultaneous opening of the wrapping and the coupon, it is not absolutely necessary for the two lines of pre-weakened is resistance, of the coupon and of the wrapping, to be exactly superimposed, a certain lateral positioning tolerance on the order of 1 mm being permissible and/or preferred.

Although the embodiment has been described in relation to the coupon 3, any form of information or decorative flyer can be used in place of, or in combination with, a coupon.

What is claimed is:

1. A wrapping of an object, said wrapping comprising:

an outside wrapping sheet provided with an opening mechanism comprising a first opening line disposed on at least one face of said wrapping; and at least one of a closed coupon and a flyer being attached to at least a portion of at least one outer face of said outside wrapping sheet, said at least one of a coupon and a flyer being provided with a second opening line disposed so that the opening of the wrapping by the opening mechanism causes a simultaneous opening of the at least one of a coupon and a flyer.

2. The wrapping according to claim 1, wherein:

the at least one of a coupon and a flyer is made up of at least one leaf folded along at least one folding line, the portion of said at least one leaf opposite the at least one folding line being closed;

said second opening line being disposed between the at least one folding line and said closed opposite portion, the at least one of a coupon and a flyer being attached to the wrapping in such a way that said second opening line is disposed parallel and in immediate proximity to at least one portion of said first opening line; and said at least one of a coupon and a flyer including a first portion disposed between the at least one folding line and the second opening line, as well as a second portion disposed between the second opening line and said closed opposite portion, said first portion of the at least one of a coupon and a flyer being attached to a first portion of the wrapping, while said second portion of the at least one of a coupon and a flyer is attached to a second portion of the wrapping.

3. The wrapping according to claim 1, wherein the first opening line comprises a tear tape.

4. The wrapping according to claim 1, wherein the first opening line comprises a first line of weakened mechanical resistance and a tear thread superimposed on said first opening line and disposed on the inner face of said outside wrapping sheet.

5. The wrapping according to claim 4, wherein at least one of the first and the second lines of weakened resistance comprises a perforated line.

6. The wrapping according to claim 4, wherein at least one of the first and the second lines of weakened resistance comprises a line of reduced thickness.

7. The wrapping according to claim 1, wherein the second opening line comprises a second line of weakened mechanical resistance.

8. The wrapping according to claim 1, wherein at least a portion of the at least one of a coupon and a flyer is attached to a side face of the wrapping.

9. The wrapping according to claim 8, wherein a portion of the at least one of a coupon and a flyer is attached to an end face of the wrapping.

10. The wrapping according to claim 1, wherein the at least one of a coupon and a flyer includes an inside insert capable of being unfolded after opening of the at least one of a coupon and a flyer and of the wrapping, respectively.

11. The wrapping according to claim 1, wherein the at least one of a coupon and a flyer includes a detachable inside insert.

12. The wrapping according to claim 1, wherein at least the portion of the face of the at least one of a coupon and a flyer applied to the wrapping, including the end of the second opening line at which the opening of the at least one of a coupon and a flyer will be started, is glued to said wrapping.

13. The wrapping according to claim 1, containing one or more products of the food industry.

14. A carton containing a plurality of packs of products of the tobacco industry, the carton being provided with the wrapping according to claim 1.

15. A pack of products of the tobacco industry provided with the wrapping according to claim 1.

16. A process for producing the wrapping according to claim 1, comprising:

moving an object wrapped with said outside wrapping sheet in a given direction through a machine;

detecting the position of the object in a given location of the machine with a sensor;

indicating to a device for applying at least one of a coupon and a flyer the position of the object when the object is disposed facing the device; and applying at least one of a coupon and a flyer with said device to said object wrapped with said outside wrapping sheet.

17. The process according to claim 16, wherein the device for applying at least one of a coupon and a flyer is a distributor for at least one of a coupon and a flyer.

18. The process according to claim 16, wherein the device for applying at least one of a coupon and a flyer is a placing arm bearing a support tape to which the at least one of a coupon and a flyer are successively, non-permanently attached, said placing arm detaching the at least one of a coupon and a flyer from said support tape and applying said at least one of a coupon and a flyer to the object wrapped with said outside wrapping sheet.

19. The process according to claim 18, wherein a glue applicator applies one or more spots, one or more lines, or a surface of glue to the wrapping before application of the at least one of a coupon and a flyer to said outside wrapping sheet.

20. A process for producing the wrapping according to claim 1, comprising:

moving a web of the material intended t o make u p s aid wrapping in a given direction on a wrapping-preparation machine;

sequentially applying at least one of a coupon and a flyer with a device to a corresponding portion of said web, said application being controlled by a control unit capable of synchronizing the application of the at least one of a coupon and a flyer with operation of the wrapping-preparation machine.

21. The process according to claim 20, wherein a glue applicator applies one or more spots, one or more lines, or a surface of glue to the wrapping before application of the at least one of a coupon and a flyer to said wrapping or said web.

22. The process according to claim 20, wherein the device for applying at least one of a coupon and a flyer is a distributor for at least one of a coupon and a flyer.

23. The process according to claim 22, wherein a glue applicator applies one or more spots, one or more lines, or a surface of glue to the wrapping before application of the at least one of a coupon and a flyer to said wrapping or said web.

24. The process according to claim 20, wherein the device for applying at least one of a coupon and a flyer is a placing arm bearing a support tape to which the at least one of a coupon and a flyer are successively, non-permanently attached, said placing arm detaching the at least one of a coupon and a flyer from said support tape and applying said at least one of a coupon and a flyer to the web.

25. The process according to claim 24, wherein a glue applicator applies one or more spots, one or more lines, or a surface of glue to the wrapping before application of the at least one of a coupon and a flyer to said wrapping or said web.

* * * * *